US006554716B1

(12) United States Patent
Loh et al.

(10) Patent No.: US 6,554,716 B1
(45) Date of Patent: Apr. 29, 2003

(54) GOLF "SWING FOR ACCURACY" MAT

(76) Inventors: James Cheng Wah Loh, 8818 Emperor Ave., San Gabriel, CA (US) 91775; Yi Ni Wu, 8818 Emperor Ave., San Gabriel, CA (US) 91775

( * ) Notice: Subject to any disclaimer, the term of this patent is extended or adjusted under 35 U.S.C. 154(b) by 0 days.

(21) Appl. No.: 09/635,989

(22) Filed: Aug. 9, 2000

(51) Int. Cl.[7] ..... A63B 69/36
(52) U.S. Cl. ..... 473/148; 273/149
(58) Field of Search ..... 473/139, 147, 473/148, 149, 278, 279

(56) References Cited

U.S. PATENT DOCUMENTS 1,798,983 A * 3/1931 Parsons ..... 473/148
2,297,118 A * 9/1942 Wildegans ..... 473/149
3,126,206 A * 3/1964 Sabia ..... 473/147
3,229,982 A * 1/1966 Waltenbaugh ..... 473/148
3,472,075 A * 10/1969 Oppenheimer ..... 473/148
3,647,219 A * 3/1972 Ravatt ..... 473/148
4,717,153 A * 1/1988 Breen ..... 473/148
5,255,920 A * 10/1993 Mangeri ..... 473/147
5,275,406 A * 1/1994 Smagula ..... 473/148
5,366,225 A * 11/1994 Lazar ..... 473/148
5,513,842 A * 5/1996 Fuss ..... 473/148
5,527,042 A * 6/1996 Spriddle ..... 473/279
5,865,683 A * 2/1999 Yang ..... 473/147

* cited by examiner

*Primary Examiner*—Mark S. Graham
(74) *Attorney, Agent, or Firm*—Raymond Y. Chan; David and Raymond Patent Group

(57) ABSTRACT

A Golf "Swing For Accuracy" Mat for promoting accurate and consistent contact between a golf club and a golf ball as a golfer swings the golf club, wherein the first preferred embodiment of the Golf "Swing For Accuracy" Mat includes a mat, a ball device including an upper sphere having a connecting arm, a lower sphere having a connecting arm, wherein the two spheres are vertically aligned above the mat with a predetermined distance between the spheres, and a means for supporting the ball device in position above the mat.

15 Claims, 7 Drawing Sheets

GOLF "SWING FOR ACCURACY" MAT

CROSS REFERENCE OF RELATED APPLICATION

This is a regular application of a provisional application, filed on Aug. 9, 1999.

FIELD OF THE PRESENT INVENTION

The present invention relates to a a golf swing trainer, and more particularly, to a Golf "Swing For Accuracy" Mat for assisting a golfer to learn how to accurately and consistently make contact with a golf ball.

BACKGROUND OF THE PRESENT INVENTION

The adjustable golf swing can be broken down to any number of components: the backswing, the follow through, the takeaway, the grip, the hand positions, the head position, the position of the shoulders and so on. And there are just as many if not more types of swings exhibited by golfers. But in the end, it comes down to the same result, making solid contact with the golf ball at the point of impact.

In particular, for a beginner, learning how to make solid contact can often be difficult, and even embarrassing, even on a driving range. No one enjoys taking a swing at a golf ball on the range and having it clang against the wall dividing one golfer from another. Nor does any golfer enjoy standing on the first tee, and seeing his tee shot role 3 inches in front of him because he swung to high, or pop straight up in the air because he swung too low.

A golfer is taught that the proper golf swing for using an iron is to have the ball on or very close to the ground (if teed up), and the golf club swung in an arc such that just before the club reaches the lowest point of the arc, it makes contact with the back of the ball, imparting back spin to the ball. During a round of golf, this means that a proper swing requires the golf club to hit the ball, then hit the ground. Golfers often speak of making a divot in the ground just in front of the ball as an indication that the golfer has properly swung the club through the required arc. The problem for every golfer, and in particular, beginners, is that most swing trainers do not allow the golfer to learn, or practice swinging a golf club so that he can have this feeling and proper motion.

For a golf ball that is teed up for a driver or wood, there is the additional problem of the golfer constantly hitting the top of the ball first, "topping" the ball, and making it either roll, or go lower in the air than the golfer desires. In both cases, the problem for the golfer is making solid contact within the parameters of the desired swing.

There are many swing trainers that teach making solid contact with a golf ball. The majority of these trainers consist of a ball hung from some type of support, or scaffolding. They are designed to be used indoors or outdoors, in enclosed areas, or areas where it is not possible to freely hit a golf ball even 5 yards, much less 100 yards. A golfer swings a golf club hitting the ball, which then swings, or springs away in a vertical circle.

In addition, there are some swing training devices which hold a golf ball out an arm at a right angle from the ground, horizontally from the supporting apparatus. This type of swing training device holds the ball up at a specific height but can be made adjustable. In either form, most commonly, there is only one golf ball. Similar to a vertical device, the golfer swings at the ball, making the ball either spin horizontally, or spin away, then spring back.

In most cases, to adjust the height of the ball from the ground, the golfer is required to turn some knobs, or otherwise manipulate the supporting apparatus that is connected to the ball or connects to the part of the structure that attaches directly to the ball, namely a string or rod. This can prove to be quite cumbersome and time consuming, especially for an individual not mechanically inclined, or is new to the game of golf. In particular, for beginners, they do not understand enough about golf to be able to adjust the trainer easily between several different heights, for an iron or a wood golf club, or between hitting the ball off the ground or off of a tee, since they do not understand where the ball should be in relation to the club they are using or the type of shot they are trying to practice.

Over time, this type of conventional swing trainer has also become more complex in construction, having several pulleys, springs, magnets, gears, etc. designed to help adjust the height of the ball and it's return after hitting it.

A few of these types of swing trainer have been used with a mat as well, but very little if any attention has been paid to use of a mat as an integral part of a swing guidance system. Normally, the mat is just described as something that is underneath the ball, without detailing how the mat might improve the system. And often, the mat is just a flat piece of plastic, which does not allow the golfer to get swing the club properly.

Some mats have been produced having plastic strips to rest the ball on, allowing a golfer to swing down through the ball and into the ground, however, the problem with this type of mat is that over type, the plastic strips droop lower and lower with wear and tear, even from after the first use. The golfer than must continually alter his swing to account for the reducing give of the mat as the strips wear down. Some mats also have special pockets, but are designed specifically for the ball to sit in the pocket so that a golfer duplicates an uncommon golf shot, out of the "rough" or ungroomed part of the golf course where the grass has been allowed to grow high. This type of mat is not designed to teach a golfer how to swing a golf club normally, but only for special golf shots.

Another problem with the conventional swing trainers is that the swing that the individual learns is often very different than the natural swing the golfer uses on the golf course. This is associated specifically with the design of the trainer. The natural adjustable golf swing requires an arc. If the golf ball is not on a tee, as is the normal situation over 70 or 80% of the time for the average golfer, the club swings through the ball, cutting down on it first, and then hitting through the ground in front of the ball, making a divot. Conventional swing trainers do not take into account this natural swing motion, either having a mat that is flat, or no mat. If the ball is on the ground, the golfer bounces the club off the ground.

To the present, none of these swing trainers has combined any of these elements of using two golf balls, or simulate golf balls, being able to adjust both golf balls for various club heights, not only for the purpose of hitting the golf ball, but also for the purpose of promoting solid contact by avoiding a second golf ball, being able to adjust those heights simply, and with a limited number of moving parts, and also providing a mat which helps to promote a downward swing for iron shots.

The Golf "Swing For Accuracy" Mat of the present invention addresses these issues. It provides all of the advantages of the conventional swing trainers, but offers more. The Golf "Swing For Accuracy" Mat can be used with one or two balls, with or without a mat that assists in teaching the adjustable golf swing, and is of simpler design, allowing for easy adjustability and use by beginner or advanced golfer. Most importantly, the Golf "Swing For Accuracy" Mat helps a golfer to not only learn to make solid contact with a ball, but can encourage a golfer to use the proper motion for swinging a club, keeping the club low so as to avoid topping the ball, and promoting a swing using the same motion the golfer would use on a golf course.

SUMMARY OF THE PRESENT INVENTION

The main object of the present invention is to provide an Golf "Swing For Accuracy" Mat having two spheres aligned vertically above a mat that promotes swinging through the lower sphere and avoiding topping the lower sphere by avoiding contact with the higher sphere.

A further object of the present invention is to provide an Golf "Swing For Accuracy" Mat having two spheres supported above a mat and aligned vertically such that the spheres may be aligned at a predetermined distance between the two spheres for promoting solid contact with the lower sphere and avoiding contact with the upper sphere.

A further object of the present invention is to provide an Golf "Swing For Accuracy" Mat of simple construction and fewer moving parts to allow for easier repair or replacement of parts.

A further object of the present invention is to provide a Golf "Swing For Accuracy" Mat that is easy to operate from a beginner to a seasoned professional.

A further object of the present invention is to provide a Golf "Swing For Accuracy" Mat of simple construction so that it can be set up quickly and easily almost anywhere.

Still a further object of the present invention is to provide a Golf "Swing For Accuracy" Mat that allows for easy adjustment of the height of the sphere for practicing simulated golf shots from the ground and from a tee of various heights.

Still a further object of the present invention is to provide a Golf "Swing For Accuracy" Mat that promotes a proper downward motion of the golf swing by providing a mat with an inclining surface sloping down and away from the sphere allowing the golfer to properly swing down and through the ball and into the surface of the mat.

Yet another object of the present invention is to a Golf "Swing For Accuracy" Mat having a mat that duplicates how the ground is supposed to look after a golfer hits a golf ball off the ground using a specific type of club, an iron, in order to train a golfer how to properly swing an iron through the ball and ground.

Accordingly, in order to accomplish the above objects, the present invention provides a Golf "Swing For Accuracy" Mat for promoting accurate and consistent contact between a golf club and a golf ball as a golfer swings the golf club, wherein the first preferred embodiment of the Golf "Swing For Accuracy" Mat comprises:

a mat, a ball device comprising an upper sphere having a connecting arm, a lower sphere having a connecting arm, wherein the two spheres are vertically aligned above the mat with a predetermined distance between the spheres, and a means for supporting the ball device in position above the mat.

Alternatively a Golf "Swing For Accuracy" Mat of a second preferred embodiment comprises:

a mat having an inclining surface for ensuring a correct downward swing through the sphere, a ball device comprising a single sphere having a connecting arm, wherein the sphere is supported above the mat at a predetermined distance, and a means for supporting the ball device in position above the mat.

Alternatively a Golf "Swing For Accuracy" Mat of a third preferred embodiment comprises:

a mat having an inclining surface for ensuring a correct downward swing through the sphere.

DETAILED DESCRIPTION OF THE PREFERRED EMBODIMENT

Figure 1:
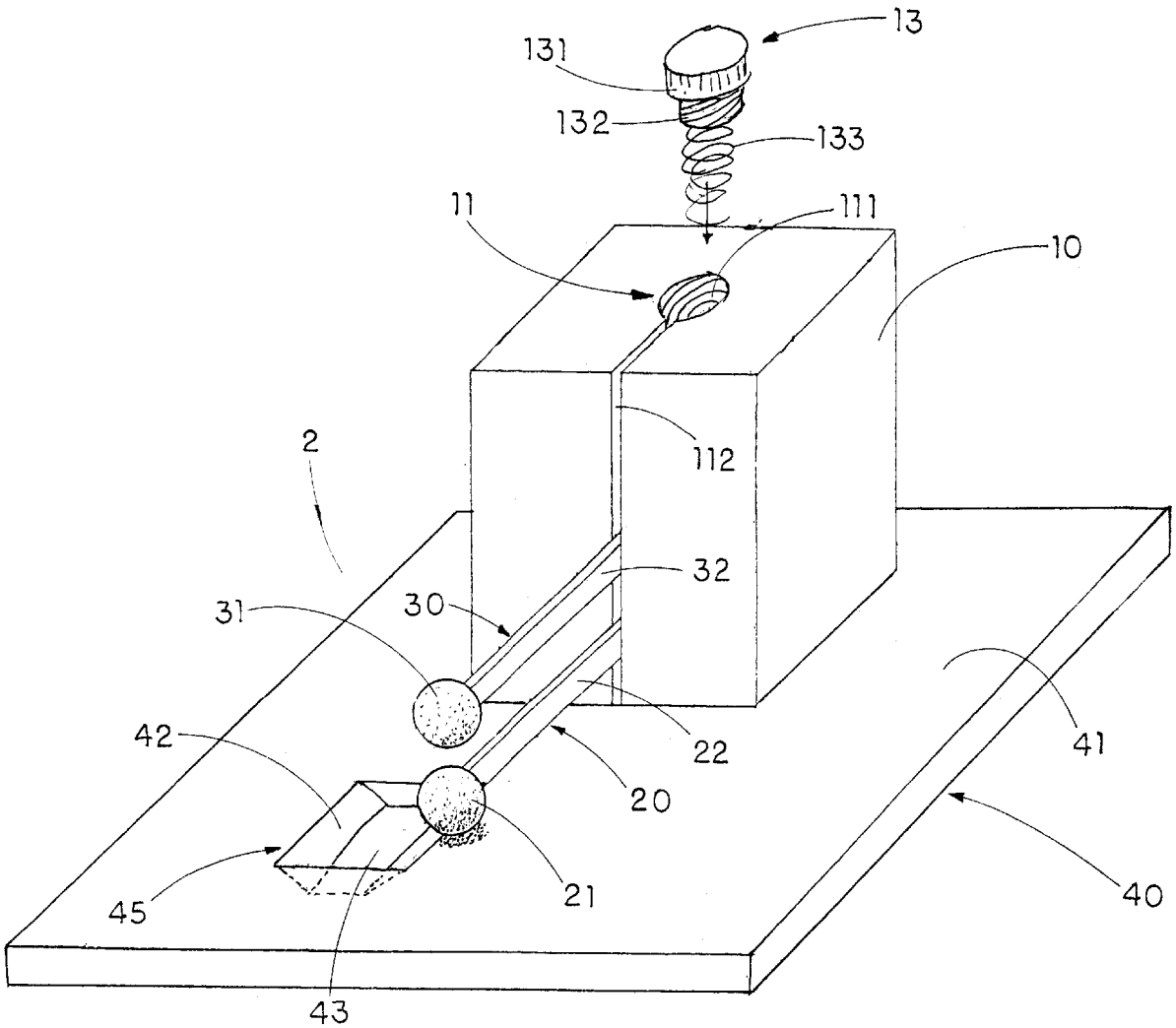
FIG. 1 is a perspective view of a Golf "Swing For Accuracy" Mat according to a preferred embodiment of the present invention.

Referring to FIGS. 1 to 5 a first preferred embodiment of the present invention of an Golf "Swing For Accuracy" Mat is illustrated. This invention is a device that helps the golfer hit the ball with more accuracy and to learn to make contact correctly, depending on the type of shot. Referring to FIG. 1, the means for supporting a ball device 2 is a plastic, metal or wood block 10 is attached to a plastic or rubber mat 40. The ball device 2 comprised of two practice arms 20, 30 are made of a rigid, but flexible material, such as rubber or plastic, and are inserted into a slot 11 cut into the block, such that the practice arms 20, 30 are parallel to the ground and are vertically aligned. The slot 11 is composed of a bulbous end 111 and a straight extension 112. A stabilizer 13 can then be inserted into the slot 11 above the second practice arm 30 to hold the practice arms 20, 30 in place in the slot 11 while the golf swing guidance system is in use.

Figure 2:
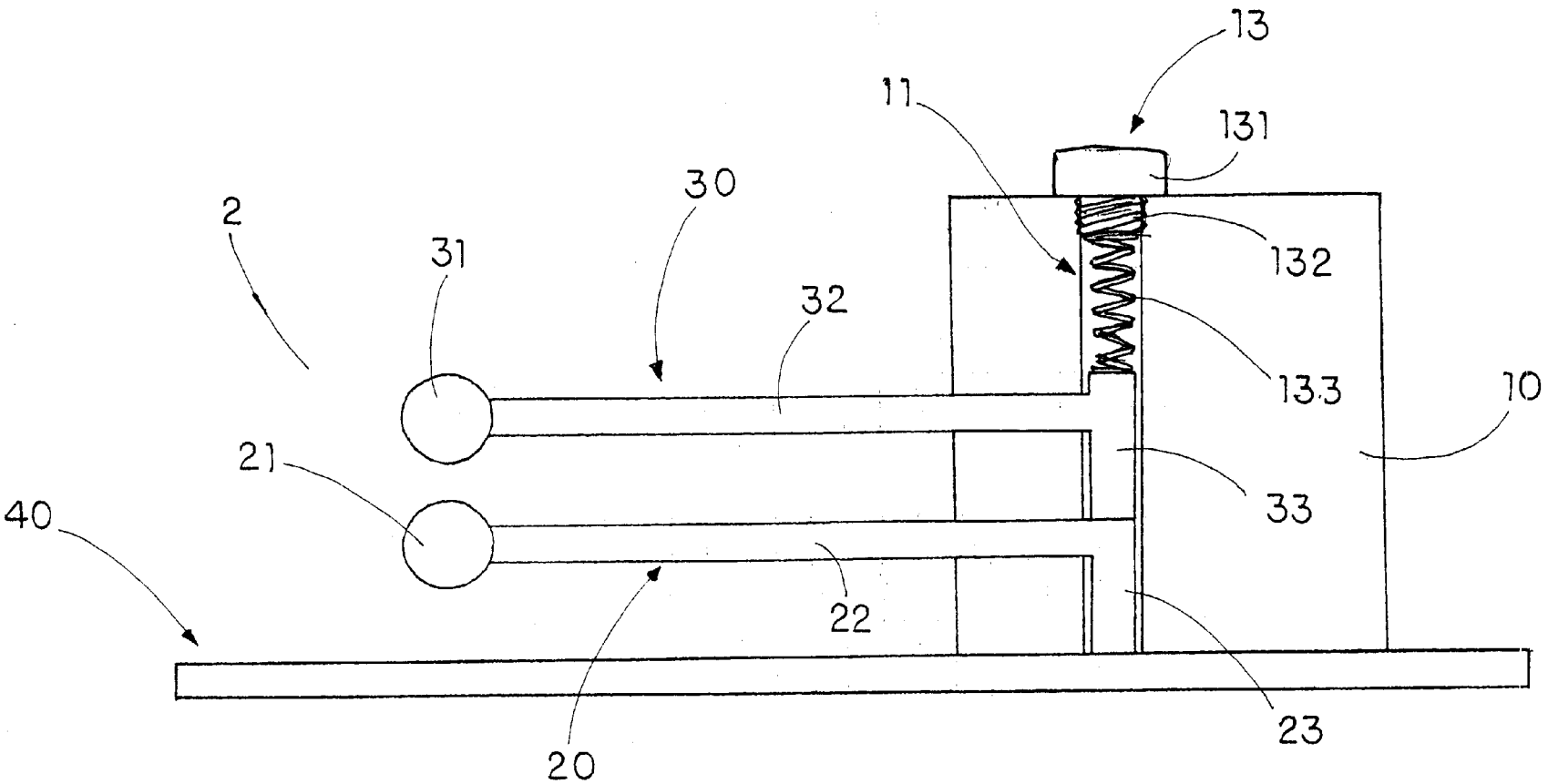
FIG. 2 is a side perspective view of the Golf "Swing For Accuracy" Mat according to the above preferred embodiment of the present invention.
Figure 3:
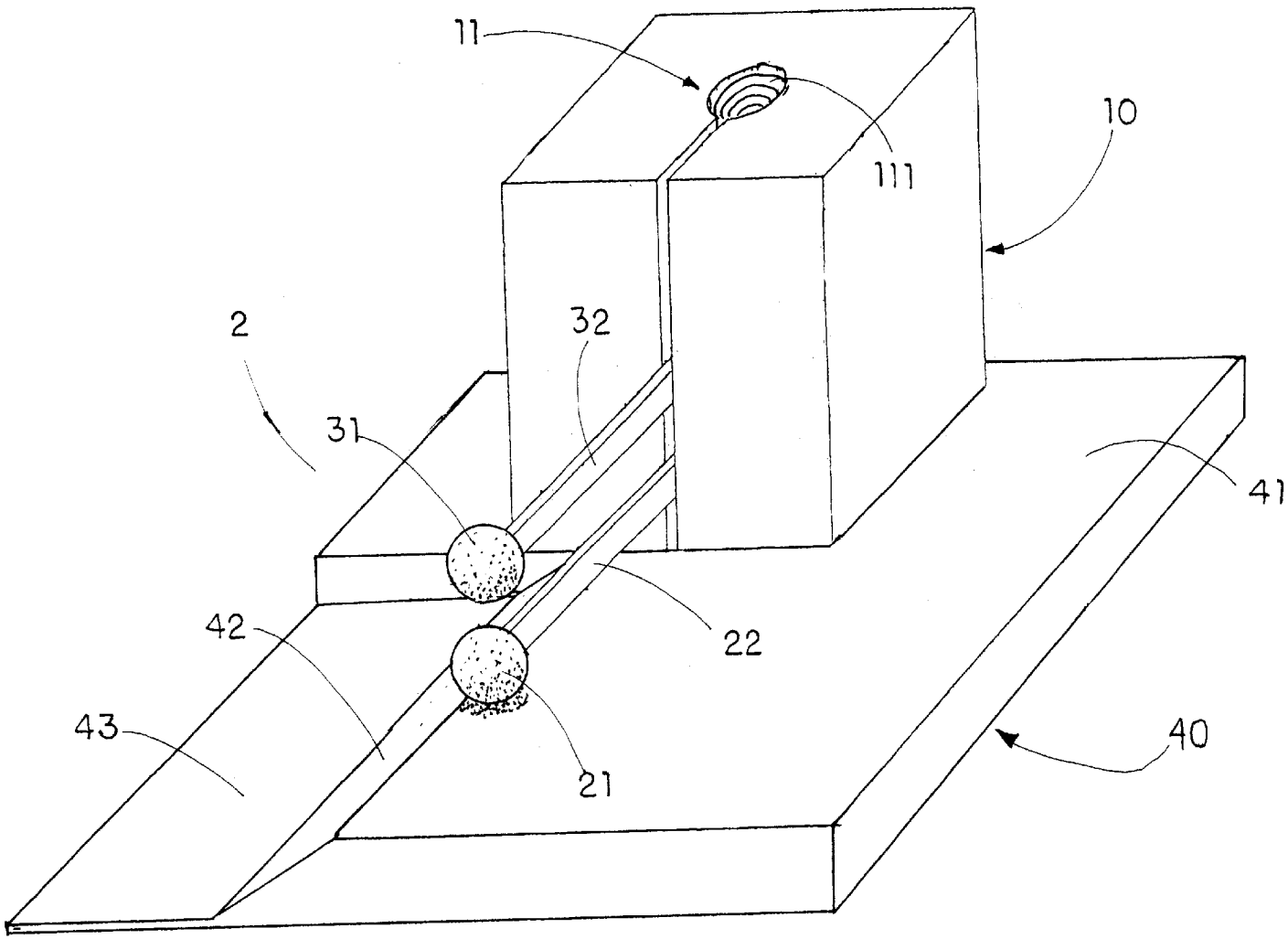
FIG. 3 is a perspective view of the Golf "Swing For Accuracy" Mat according to the above preferred embodiment of the present invention.
Figure 5:
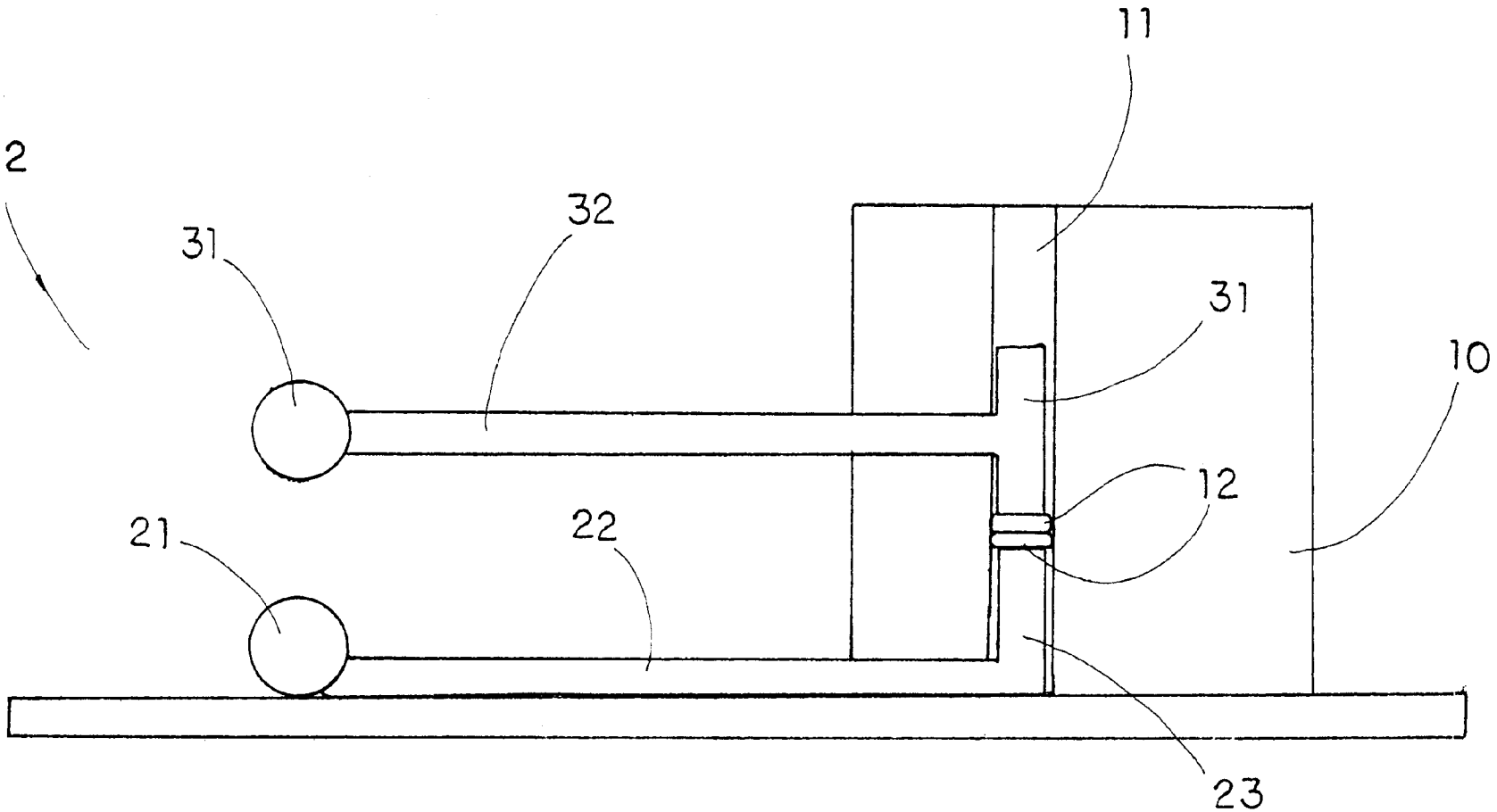
FIG. 5 is a side perspective view of. the Golf "Swing For Accuracy" Mat according to the above preferred embodiment of the present invention.

Referring to FIGS. 2 and 5, each practice arm 20, 30 has a first endpiece 23, 33, a connecting arm 22, 32, and a second endpiece 21, 31, which is formed into the shape of a sphere. The first endpiece 23, 33 is columnar. Various practice arms 20, 30 may be used in which the connecting arm 22, 32 attaches to the first endpiece 23, 33 of the practice arm 20, 30 at various places on the first endpiece 23, 33. As shown in FIGS. 2 and 5, the connecting arm 22, 32 connects to the first endpiece 23, 33 along the height of the first endpiece 23, 33. The connecting arm may connect to the first endpiece 23, 33 at one end of the first endpiece 23, 33, or at any point up to the middle of the first endpiece 23, 33. The first endpiece 23, 33 and part of the connecting arm 22, 32 are fittedly inserted into the slot 11 of the block 10 in preparation for using the Golf "Swing For Accuracy" Mat. The first endpiece 23, 33 of the practice arm 20, 30 may be inserted with either end of the columnar first endpiece 23, 33 facing down in the bulbous end 111 of the slot 11, thereby varying the distance the second endpiece, or sphere 21,31, rests from the surface of the mat 40. The height of the upper practice arm 30 is adjusted in relation to how the lower practice arm 20 is adjusted to assure that the golf club to be used, if swung properly, will hit the sphere 21 of the lower practice arm 20 while avoiding hitting the sphere 31 of the upper practice arm 30. The golfer, by adjusting the height of the sphere 21 of the lower practice arm 20 may adjust the height of the sphere 21 to simulate a drive off of a tee for various golf clubs, or off of the mat 40.

The height of the sphere 31 of the upper practice arm 30 is generally just higher than the height of a golf club as it is hitting the lower practice arm 20. If the golfer can swing the golf club through the lower practice arm 20 without touching the upper practice arm 30 consistently in his or her living room, he or she would not have trouble hitting the ball accurately in the golf course.

In a first alternative to the first preferred embodiment of the present invention, the practice arm 20, 30 further comprises at least one set of nuts and bolts 14, 15, which go through the practice arms 20, 30 via at least one adjustment slot 16 which crosses the vertical slot 11. The bolt 14 is inserted through a through hole 24, 34 on the practice arm 20, 30 and screwed tight against the block 10 to secure the practice arms 20, 30. These nuts and bolts can also be used to adjust the height of the practice arms.

Figure 4:
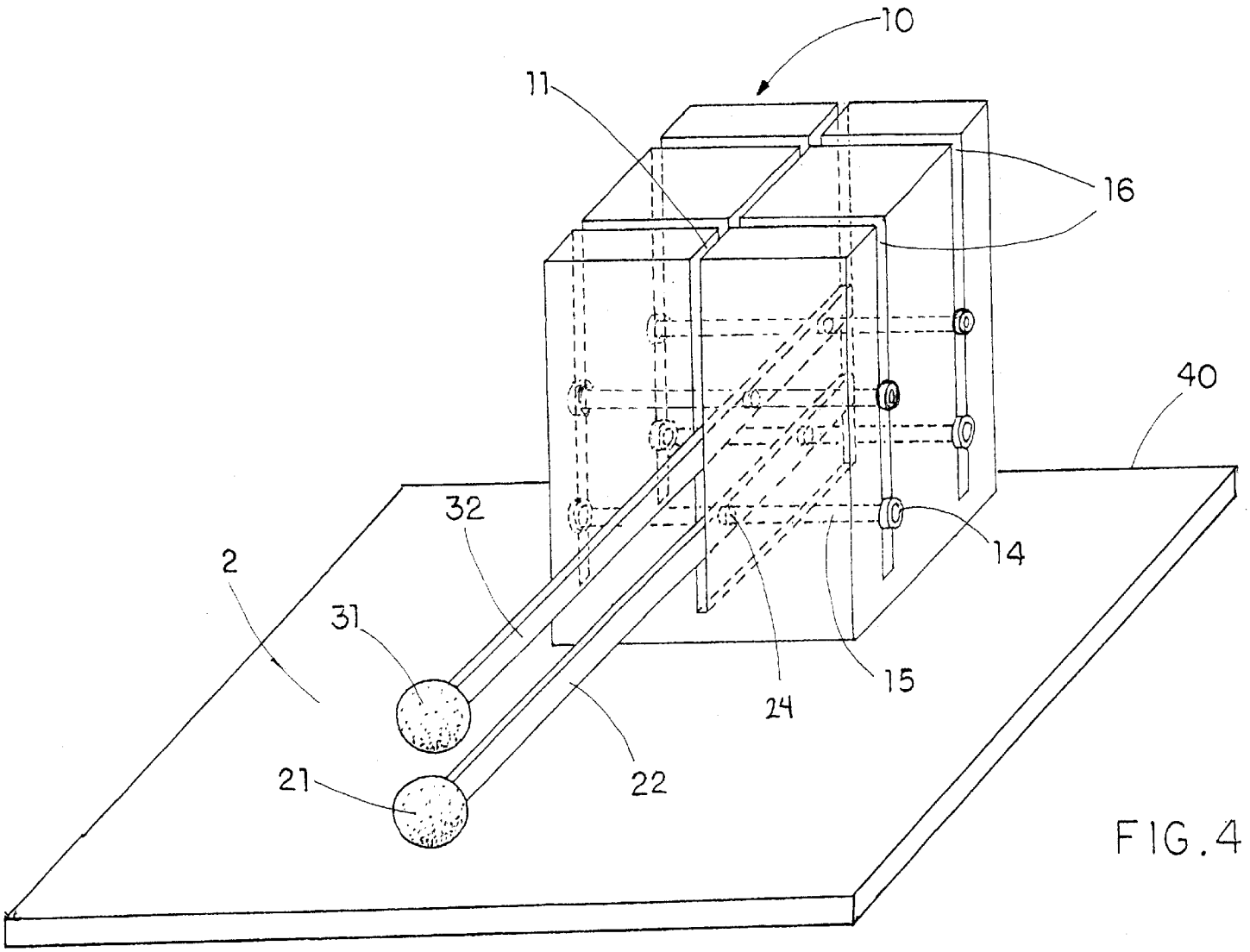
FIG. 4 is perspective view of a first alternative of the Golf "Swing For Accuracy" Mat according to the above preferred embodiment of the present invention.

Referring to FIGS. 1 through 5, a mat 40 is shown. This gives the golfer a cushion to his swing so that he may swing down and through the ball in the traditional manner. Referring to FIGS. 2, 4 and 5, the mat 40 may be a standard flat mat, may have two levels 41, 43 with an inclining surface 42 between them (FIG. 3), where the inclining surface 42 slopes down and away from the higher flat surface 41. The mat 40 may even have a depression only in the middle, similar to a divot 45 (FIG. 1). These alternatives are used to reinforce in the mind of the golfer the idea of hitting down and through a golf ball when it rests on the ground, allowing for both cushion and leeway for the golfer to swing his club naturally when practicing.

When the lower practice arm 20, is set up properly with a mat 40 having an inclining surface 42, the lower sphere 21 may rest on the mat 40 directly along the upper edge of the inclining surface 42. The two spheres 21, 31 can be made of the same material and can be made of different colors so that the golfer can easily tell whether the club head in the swing is hitting the upper sphere 31.

When a golfer swings his golf club and makes contact with the lower sphere 21, the presence of the upper sphere 31 of the upper practice arm 20 reinforces the golfer's thought to "keep the swing down."

Referring to FIG. 5, spacers 12 can be used under either practice arm 20, 30 to adjust the height of either practice arm 20, 30 relative to the ground or to the other practice arm 30, 20. These spacers 12 are used to keep the practice arms 20, 30 at a certain height and in a level position. There are other methods in addition to the spacers 12 and stabilizer 13, or nuts and bolts 14, 15, to hold the practice arms 20, 30 in place. For example the mechanism that is used for an adjustable crescent wrench can also be attached to the block 10 and used to move the practice arms 20, 30, separately, up and down the slot 11. In addition, the spacers 12 can be constructed disks, cubes, or can even be coins.

The main idea of this invention is that by choosing or adjusting the heights of the two practice arms 20, 30 the golfer is forced to swing the club at the same height at the bottom ball more accurately and consistently if the club head doesn't touch either the upper sphere 31 or the mat 40 (in the case where the golfer is learning how to hit tee shots).

Figure 6:
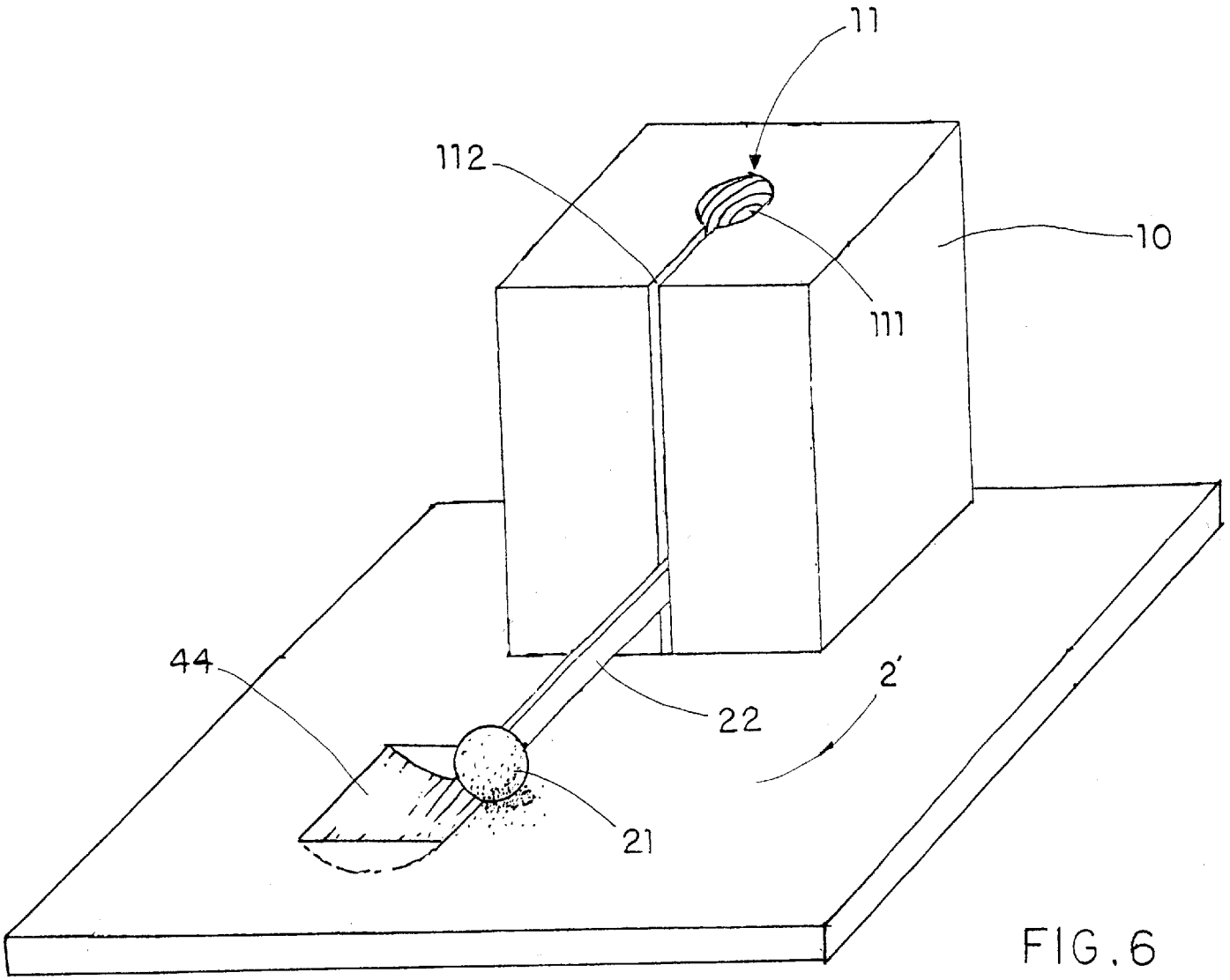
FIGS. 6 is a front perspective view of the Golf "Swing For Accuracy" Mat according to a second preferred embodiment of the present invention.
Figure 7:
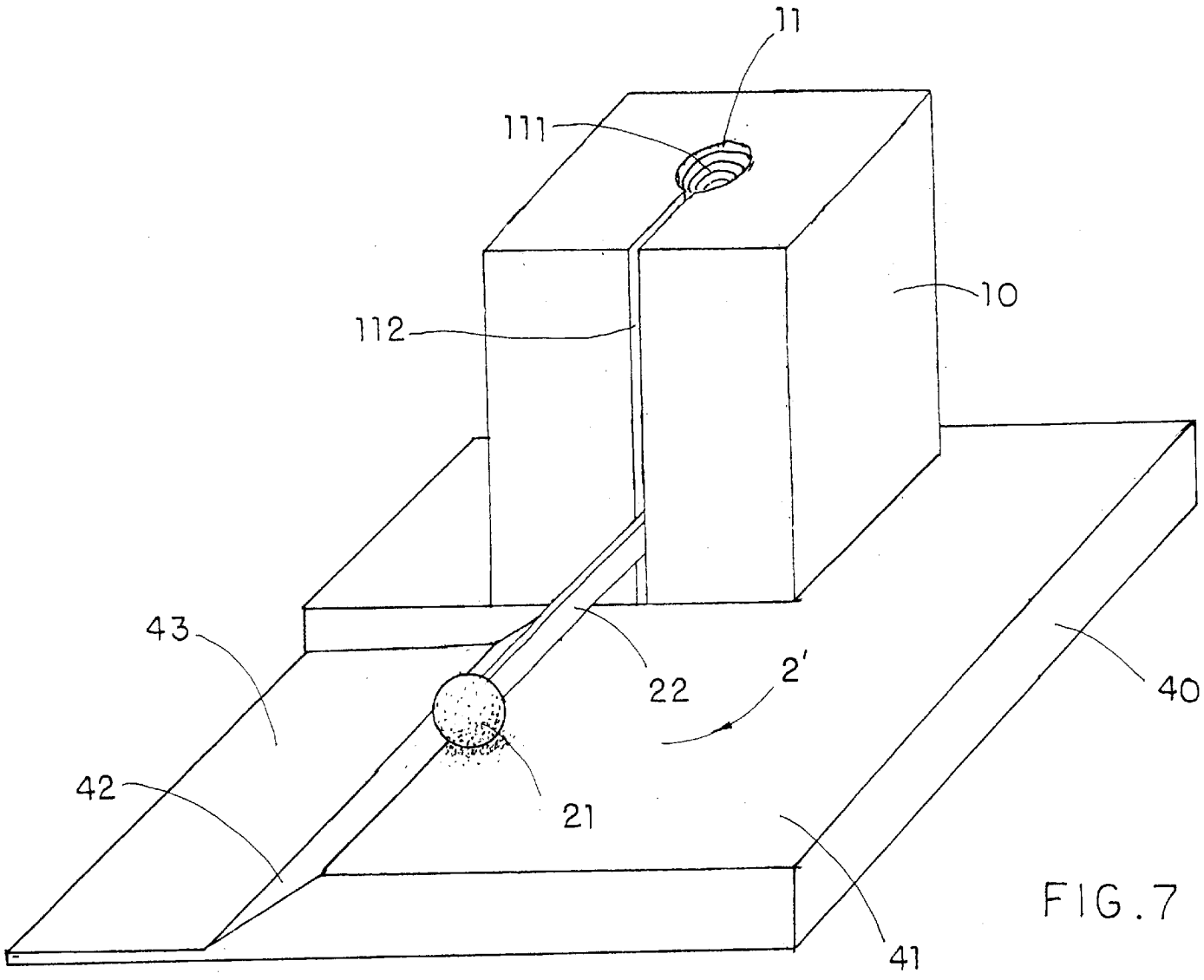
FIG. 7 is another front view of the Golf "Swing For Accuracy" Mat according to the second preferred embodiment of the present invention.

Referring to FIGS. 6 to 7, a second preferred embodiment of the present invention is illustrated. The second preferred embodiment consists of a mat 40 with an inclining surface 42, a ball device 2' consisting of a single practice arm 20, and a means for supporting the ball device 2', which is a block 10. The practice arm 20 is supported above the mat 40 by the block 10. The mat 40 has a higher flat surface 41, an inclining surface 42 and a lower flat surface 43 (FIG. 7). The higher surface 41 integrally connects to the top edge of the inclining surface 42, which slopes downwardly to the lower surface 43. Alternatively, the inclining surface can be circular to form a divot 45 (FIG. 6). The mat 40 is aligned so that when the sphere 21 rests on or above the mat 40, the sphere 21 is above the upper edge of the inclining surface.

The inclining surface 42 and lower surface 43, or the divot 45, provided on the mat 40 are designed to encourage a golfer to swing down on the lower back part of the sphere 21 and into the ground, as a golfer is normally taught to do. The golfer stands opposite the block 10, with the practice arm 20 pointed at him. The inclining surface 42 is to the side of the practice arm 20 such that when the golfer swings, the arc of his swing will bring the club head in contact with the back of the sphere 21 with a downward swing, and the golfer will continue swinging the club in an arc such that the club head will bottom out at the lower surface 43. The golfer's natural swing bringing the ball through the inclining surface 42 and lower surface 43 is not abbreviated or stopped by the ground, just as the golfer would create a divot on a golf course if the club properly swings downward after contacting the golf ball. With the Golf "Swing for Accuracy" Mat of the second preferred embodiment, the golfer knows he has made a proper swing by first his contact with the sphere 21 of the practice arm 20 and then contact by the golf club with the lower surface 43 at the bottom of the inclining surface 42.

Alternatively, an indicator, such as tape, or chalk, may be placed onto the lower surface 43 to provide the golfer with another indicator that he is swinging the golf club properly.

Accordingly, a third preferred embodiment is also illustrated. The third preferred embodiment of the Golf "Swing for Accuracy" Mat consists of a mat having two flat surfaces 41, 43, an higher. surface 41, and a lower surface 43, integrally connected by an inclining surface 42 that slopes away from the higher surface 41 to the lower surface 43. In this preferred embodiment, a sphere 21, or a regular golf ball, or other practice golf balls is positioned on the edge of the higher surface 41 and the inclining surface 42, such that a golfer may swing a golf club in the direction of the higher surface 41 to the inclining surface 42 hitting the back of the sphere 21 or golf ball on the downward swing, and having the arc bottom out at the lower surface 43.

Alternatively, the inclining surface 42 and the lower surface 43 may be limited to a small portion of the mat 40, creating a depression or divot 45.

It is further contemplated that a marker may be placed on the lower surface 43 to indicate what contact has been made between the golf club head and the lower surface 43.

The inclining surface of the mat of the third preferred embodiment can be applied to the first and second preferred embodiments for attaining better results in learning the proper golf swing.

We claim:

1. A golf swing mat arrangement, comprising:

a mat having a flat upper surface having a hitting spot thereon, a shallow lower surface indented adjacent to said hitting spot of said upper surface, and an inclining surface sloping down from said hitting spot of said upper surface and extending to said lower surface, wherein said hitting spot lies on an upper edge of said inclining surface;

a supporting means attached on top of said mat; and a ball device comprising a lower sphere, a first practice arm having a rear end supported by said supporting means and a front end which is connected with said lower sphere and frontwardly extended from said supporting means to rest said lower sphere on said hitting spot of said mat, an upper sphere, and a second practice arm having a rear end supported by said supporting means and a front end which is connected with said upper sphere and frontwardly extended from said supporting means to position said upper sphere above said lower sphere and define a distance between said lower sphere and said upper sphere for ensuring a club head of a golf club will hit said lower sphere without hitting said upper sphere;

whereby when a golfer conducts a swing with the golf club, a down swing arc of the swing brings the club head in contact with said lower sphere and said upper sphere functions as a limitation to force the golfer to keep the swing down in order to avoid hitting said upper sphere, moreover said inclining surface formed between said upper surface and said lower surface on said mat further encourages the golfer, after hitting said lower sphere, to continue swinging the golf club in the down swing arc into said mat in such a manner that the club head is swung to bottom out at said lower surface just like the golfer has to do to create a divot while conducting a real golf swing on a golf course.

2. The golf swing mat arrangement, as recited in claim 1, wherein said mat has two levels such that one side of said mat has a higher level than the other side of said mat to form said upper surface while said other side forms said lower surface, wherein said inclining surface is an elongated surface extended between said two levels, that is sloping down and away from said upper surface to said lower surface.

3. The golf swing mat arrangement, as recited in claim 1, wherein said lower surface is indented on said upper surface for a predetermined depth at a position adjacent said hitting spot to form a divot, wherein a surrounding side of said divot is extended inclinedly to form said inclining surface and said hitting spot is positioned right at an upper edge of said inclining surface.

4. A golf swing mat arrangement, comprising:

a mat;

a ball device comprising a lower sphere, a first endpiece which is a column having a predetermined length, a first practice arm having a rear end connected to one end of said first endpiece and a front end connected with said lower sphere, an upper sphere, a second endpiece which also is a column having a predetermined length, and a second practice arm having a rear end connected to one end of said second endpiece and a front end connected with said upper sphere; and a supporting means, which is attached on top of said mat, having a vertical slot extended therethrough, wherein said slot has a straight extension vertically extended through said slot to communicate with the outside, wherein said first endpiece is inserted into said slot and sits at a bottom of said slot while said first practice arm is frontwardly extended out through said straight extension to extend said lower sphere to rest on said mat, wherein said second endpiece is also inserted into said slot and sits on top of said first endpiece while said second practice arm is frontwardly extended out through said straight extension to position said upper sphere above said lower sphere and define a distance between said lower sphere and said upper sphere for ensuring a club head of a golf club will hit said lower sphere without hitting said upper sphere;

whereby when a golfer conducts a swing with the golf club, a down swing arc of the swing brings the club head in contact with said lower sphere and said upper sphere functions as a limitation to force the golfer to keep the swing down in order to avoid hitting said upper sphere.

5. The golf swing mat arrangement, as recited in claim 4, further comprises a stabilizer inserted into said slot to press on said second endpiece so as to hold said first and second practice arms in place.

6. The golf swing mat arrangement, as recited in claim 4, further comprises at least a spacer, having a predetermined height, to place under said first endpiece inside said slot of said supporting means so as to adjust a height of said first practice arm with respect to said mat.

7. The golf swing mat arrangement, as recited in claim 5, further comprises at least a spacer, having a predetermined height, to place under said first endpiece inside said slot of said supporting means so as to adjust a height of said first practice arm relative to said mat.

8. The golf swing mat arrangement, as recited in claim 4, further comprises at least a spacer, having a predetermined height, to place between said first and second end pieces inside said slot of said supporting means so as to adjust a height of said second practice arm with respect to said first practice arm.

9. The golf swing mat arrangement, as recited in claim 5, further comprises at least a spacer, having a predetermined height, to place between said first and second endpieces inside said slot of said supporting means so as to adjust a height of said second practice arm with respect to said first practice arm.

10. The golf swing mat arrangement, as recited in claim 4, wherein said mat has a flat upper surface having a hitting spot thereon, a shallow lower surface indented adjacent to said hitting spot of said upper surface, and an inclining surface sloping down from said hitting spot of said upper surface and extending to said lower surface, wherein said hitting spot lies on an upper edge of said inclining surface, whereby said inclining surface formed between said upper surface and said lower surface on said mat further encourages said golfer, after hitting said lower sphere, to continue swinging said golf club in said down swing arc into said mat in such a manner that said club head is swung to bottom out at said lower surface just like the golfer has to do to create a divot while conducting a real golf swing on a golf course.

11. The golf swing mat arrangement, as recited in claim 5, wherein said mat has a flat upper surface having a hitting spot thereon, a shallow lower surface indented adjacent to said hitting spot of said upper surface, and an inclining surface sloping down from said hitting spot of said upper surface and extending to said lower surface, wherein said hitting spot lies on an upper edge of said inclining surface, whereby said inclining surface formed between said upper surface and said lower surface on said mat further encourages said golfer, after hitting said lower sphere, to continue swinging said golf club in said down swing arc into said mat in such a manner that said club head is swung to bottom out at said lower surface just like the golfer has to do to create a divot while conducting a real golf swing on a golf course.

12. The golf swing mat arrangement, as recited in claim 10, wherein said mat has two levels such that one side of said mat has a higher level than the other side of said mat to form said upper surface while said other side forms said lower surface, wherein said inclining surface is an elongated surface extended between said two levels, that is sloping down and away from said upper surface to said lower surface.

13. The golf swing mat arrangement, as recited in claim 11, wherein said mat has two levels such that one side of said mat has a higher level than the other side of said mat to form said upper surface while said other side forms said lower surface, wherein said inclining surface is an elongated surface extended between said two levels, that is sloping down and away from said upper surface to said lower surface.

14. The golf swing mat arrangement, as recited in claim 10, wherein said lower surface is indented on said upper surface for a predetermined depth at a position adjacent said hitting spot to form a divot, wherein a surrounding side of said divot is extended inclinedly to form said inclining surface and said hitting spot is positioned right at an upper edge of said inclining surface.

15. The golf swing mat arrangement, as recited in claim 11, wherein said lower surface is indented on said upper surface for a predetermined depth at a position adjacent said hitting spot to form a divot, wherein a surrounding side of said divot is extended inclinedly to form said inclining surface and said hitting spot is positioned right at an upper edge of said inclining surface.

* * * * *